US008128043B2

(12) United States Patent
Walter

(10) Patent No.: US 8,128,043 B2
(45) Date of Patent: Mar. 6, 2012

(54) HANGING DEVICE FOR DISPLAYING MERCHANDISE

(75) Inventor: Herbert Walter, Müllheim (DE)

(73) Assignee: Visplay International AG, Muttenz (CH)

( * ) Notice: Subject to any disclaimer, the term of this patent is extended or adjusted under 35 U.S.C. 154(b) by 878 days.

(21) Appl. No.: 12/086,381

(22) PCT Filed: Nov. 24, 2006

(86) PCT No.: PCT/CH2006/000659

§ 371 (c)(1),
(2), (4) Date: Jun. 10, 2008

(87) PCT Pub. No.: WO2007/071079

PCT Pub. Date: Jun. 28, 2007

(65) Prior Publication Data

US 2009/0166491 A1 Jul. 2, 2009

(30) Foreign Application Priority Data

Dec. 19, 2005 (DE) ..... 20 2005 019 809 U

(51) Int. Cl.
*A47B 96/00* (2006.01)

(52) U.S. Cl. ..... 248/224.7; 248/231.9; 248/221.11

(58) Field of Classification Search ..... 248/220.31, 248/220.42, 220.43, 221.11, 221.12, 222.13, 248/222.51, 223.41, 224.7, 224.8, 225.11, 248/231.9, 231.91, 239, 240.4, 220.21, 224.61, 248/234, 236, 207, 235; 211/54.1, 57.1, 211/59.1, 87.01, 123, 124

See application file for complete search history.

(56) References Cited

U.S. PATENT DOCUMENTS 4,770,380 A * 9/1988 Eason et al. ..... 248/165
4,779,830 A * 10/1988 Phelps ..... 248/250
5,485,933 A * 1/1996 Crooymans ..... 211/90.04

(Continued)

FOREIGN PATENT DOCUMENTS

DE 202 02 856 U 1 6/2002

(Continued)

OTHER PUBLICATIONS

International Search Report issued Mar. 13, 2007 by the ISA in connection with International Patent Appln. No. PCT/CH2006/000659.

(Continued)

*Primary Examiner* — Terrell McKinnon
*Assistant Examiner* — Eret McNichols
(74) *Attorney, Agent, or Firm* — McCarter & English, LLP

(57) ABSTRACT

The hanging device includes a plug-in sleeve (1), which is held in a through-hole (502) in a supporting structure (5), and a supporting arm (2) which can be inserted into the plug-in sleeve. The plug-in sleeve (1) has a sleeve piece with a front inlet into a channel, a first arresting contour (1150) which borders the channel, and a flange (10) which extends from the sleeve piece. The supporting arm (2) is fitted with a plug-in section (21) and has a first mating contour (23) which interacts with the first arresting contour (1150). A front end (22) is situated opposite the plug-in section (21). The first arresting contour (1150) is situated at a distance from the inlet into the channel. The first mating contour (23) on the plug-in section (21) is situated on the upper face with an offset in relation to the plug-in end (20).

6 Claims, 17 Drawing Sheets

U.S. PATENT DOCUMENTS

| | | | | |
|---|---|---|---|---|
| 6,631,813 | B1 * | 10/2003 | Walter et al. | 211/94.01 |
| 7,122,744 | B2 * | 10/2006 | Walter et al. | 174/163 R |
| 2008/0217271 | A1 * | 9/2008 | Walter | 211/89.01 |
| 2010/0102186 | A1 * | 4/2010 | Keyvanloo | 248/224.7 |

FOREIGN PATENT DOCUMENTS

| | | | |
|---|---|---|---|
| DE | 203 18 266.4 | | 12/2003 |
| DE | 203 19 266.4 | | 12/2003 |
| DE | 20 2004 004 783 | U1 | 7/2004 |
| EP | 1 061 837 | B1 | 4/1999 |
| GB | 2 393 382 | A | 3/2004 |
| WO | WO 99/20094 | A | 4/1999 |
| WO | WO 01/87123 | A1 | 11/2001 |
| WO | WO 03/059128 | | 7/2003 |
| WO | WO 2005/055774 | A | 6/2005 |

OTHER PUBLICATIONS

Written Opinion issued by the ISA in connection with International Patent Appln. No. PCT/CH2006/000659.

* cited by examiner

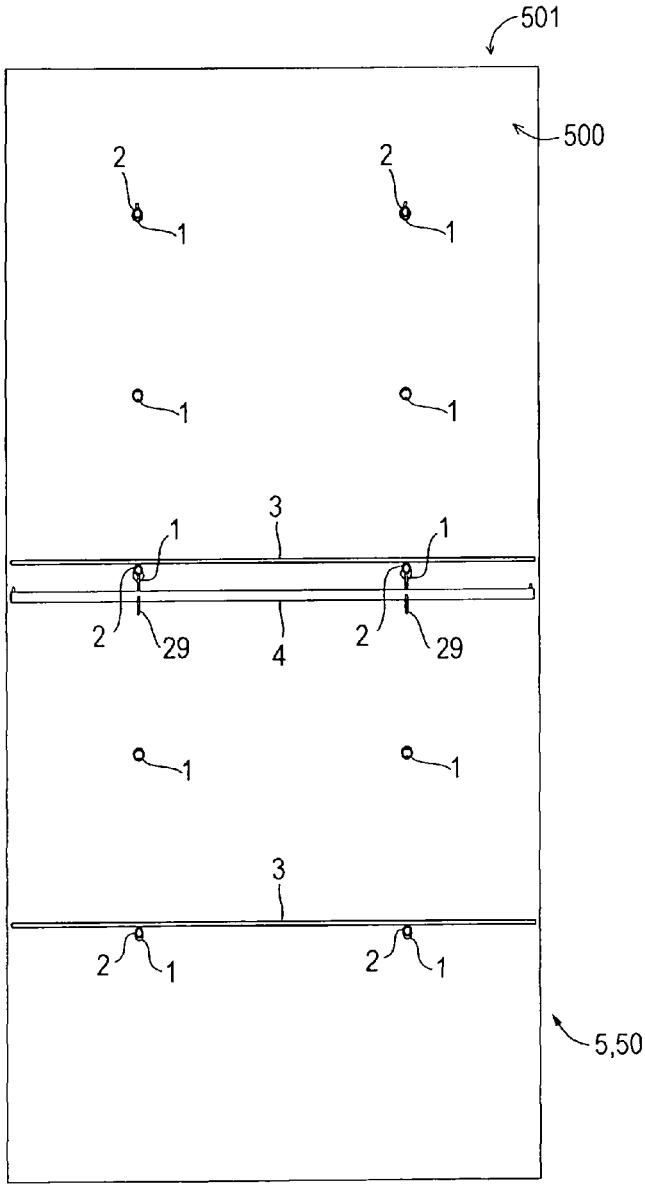
Fig. 1A
Fig. 1B
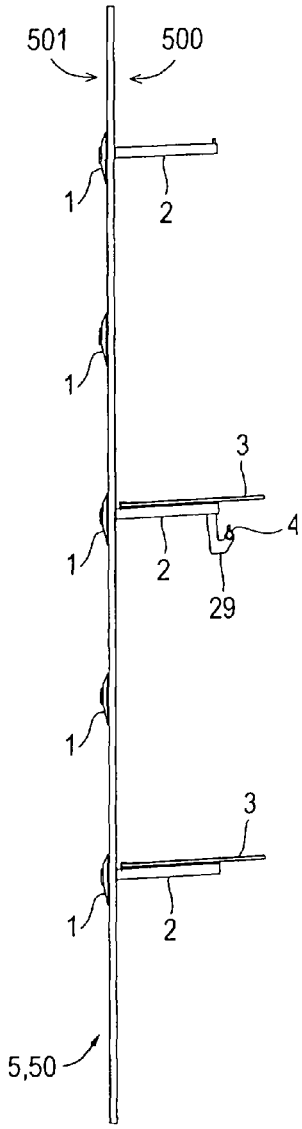

HANGING DEVICE FOR DISPLAYING MERCHANDISE

FIELD OF THE INVENTION

The invention relates to a hanging device which is composed of a sleeve, which is held by a support structure, and an arm, which can be plugged into said sleeve, as a primary merchandise carrier or for supporting a secondary merchandise carrier—for example a shelf. The device can be used individually as a bracket; using a plurality of devices of said type, it is possible to equip a presentation area in a shop. As a support structure, consideration is given for example to a fixed or a movable panel, a sub-construction or a vertical plate, composed inter alia of glass.

PRIOR ART

Hanging devices having a sleeve which is held by a support structure and having an arm which can be plugged into said sleeve are known for example from EP 1 061 837 B1, WO 01/87 123 A1, DE 202 02 856 U1, DE 203 19 266 U1 and DE 20 2004 004 783 U1.

OBJECT OF THE INVENTION

Proceeding from the generic hanging devices, the invention is based on the object of creating a different device which however gets by without spring elements.

OVERVIEW OF THE INVENTION

The hanging device is composed of a plug-in sleeve, which is held in a through hole of a support structure, and a support arm which can be plugged into said plug-in sleeve, which support arm can be utilized as a direct, primary merchandise carrier or for supporting a secondary merchandise carrier. The plug-in sleeve has a sleeve piece with a front-side inlet into a channel, at least one first locking contour which adjoins the channel, and a flange which extends from the sleeve piece. Provided on the support arm is a plug-in section which is designed for being inserted into the channel, ends at a plug-in end and has at least one first mating contour which, in the inserted end position of the support arm, interacts with the first locking contour. Situated opposite the plug-in section is a front end which is designed to extend into free space. The first locking contour is an elevation which projects into the channel from above and which is situated remote from the inlet into the channel. The first mating contour on the plug-in section is a main hole which is situated on the upper side with an offset with respect to the plug-in end. The channel has a widening downstream of its inlet in the lower region, and/or the lower region of the plug-in section is reduced in its extent in the downward direction in cross section, such that, before reaching its locked end position, the plug-in section of the support arm which is plugged into the channel in the raised oblique position has free space in said deflection.

Special embodiments of the invention are defined below: A run-on portion is positioned upstream of the first locking contour in the direction of the inlet into the channel. Complementarily to the run-on portion, a contour projection is positioned upstream of the first mating contour in the direction of the front end. The run-on portion is in principle designed as an inclined plane in the direction of the first locking contour. The contour projection is designed as a hole extension which adjoins the main hole. The widening in the plug-in sleeve is formed at least partially by a wall which slopes obliquely downward to an increasing extent in insertion depth of the channel, with it being possible for a wall opening which contributes to the widening to adjoin the obliquely downward-sloping wall.

A second mating contour is provided in addition to the first mating contour on the plug-in section of the support arm. A second locking contour which is complementary to the second mating contour can be provided in the channel. The second mating contour is a groove which opens out at the underside of the plug-in section and at the plug-in end. The second locking contour is an elevation which projects into the channel. The second locking contour rises up from the inner side of a rear plate which is to be attached to a rear face of the sleeve piece. A notch is provided in the lower wall of the sleeve piece, which notch opens out at the rear face and provides space for partially receiving the second locking contour.

A plate-like flange extends transversely through the sleeve piece, with a front section of the sleeve piece rising up, in principle, perpendicularly from the flange front side and a rear section of the sleeve piece rising up, in principle, perpendicularly from the flange rear side. The flange has screw holes for fastening to the support structure. The front section has latching contours for receiving a cover ring which serves to cover the edge of the passage hole in the support structure. The flange can be utilized for being placed with its front side onto a panel rear side, with the front section coming to rest in a passage hole, or for being placed with its rear side onto a front face of a pillar, with the rear section projecting through a cutout into the interior of the pillar.

Alternatively, a flange, preferably of circular-ring-shaped design, is integrally positioned upstream of the sleeve piece and runs around the inlet into the channel. The sleeve piece has an external thread which interacts with the internal thread of a cap nut. The flange rear side comes to rest, in the assembled state, on the front side of a support structure, preferably a vertical plate, for example composed of glass. The cap nut is screwed onto the sleeve piece from the rear side of a support structure.

The support arm is round, oval, rectangular or square in cross section and is preferably composed of tube material. The plug-in section of the support arm is unchanged in cross section in relation to the support arm or can be reduced in its extent in cross section in the downward direction. On the plug-in section of the support arm, the reduction in the extent in the lower cross-sectional region is formed so as to be axially uniform, stepped or, in principle, wedge-shaped in the direction of the plug-in end.

BRIEF DESCRIPTION OF THE APPENDED DRAWINGS

In the drawings:

FIG. 1A shows a panel as a support structure, systematically fitted with the hanging devices according to the invention, composed of plug-in sleeves inserted into the panel, and support arms, which are suspended in said plug-in sleeves, as primary merchandise carriers, by means of which individual secondary merchandise carriers are supported, in a front view;

FIG. 1B shows the illustration as per FIG. 1A, in a side view;

FIG. 4A shows the first hooking-in phase as an approaching movement of the support arm to the plug-in sleeve;

FIG. 4B shows the second hooking-in phase with the support arm obliquely raised and partially inserted into the plug-in sleeve, in the unlocked position;

FIG. 4C shows the third hooking-in phase with the support arm obliquely raised and fully inserted into the plug-in sleeve, in the unlocked position;

FIG. 4D shows the fourth hooking-in phase with the support arm pivoted toward the horizontal and fully inserted into the plug-in sleeve, in the locked, final position;

FIG. 9A shows the second hooking-in phase with the support arm obliquely raised and partially inserted into the plug-in sleeve, in the unlocked position;

FIG. 9B shows the third hooking-in phase with the support arm obliquely raised and fully inserted into the plug-in sleeve, in the unlocked position;

FIG. 9C shows the fourth hooking-in phase with the support arm pivoted toward the horizontal and fully inserted into the plug-in sleeve, in the locked, final position.

EXEMPLARY EMBODIMENT

Figure 2A:
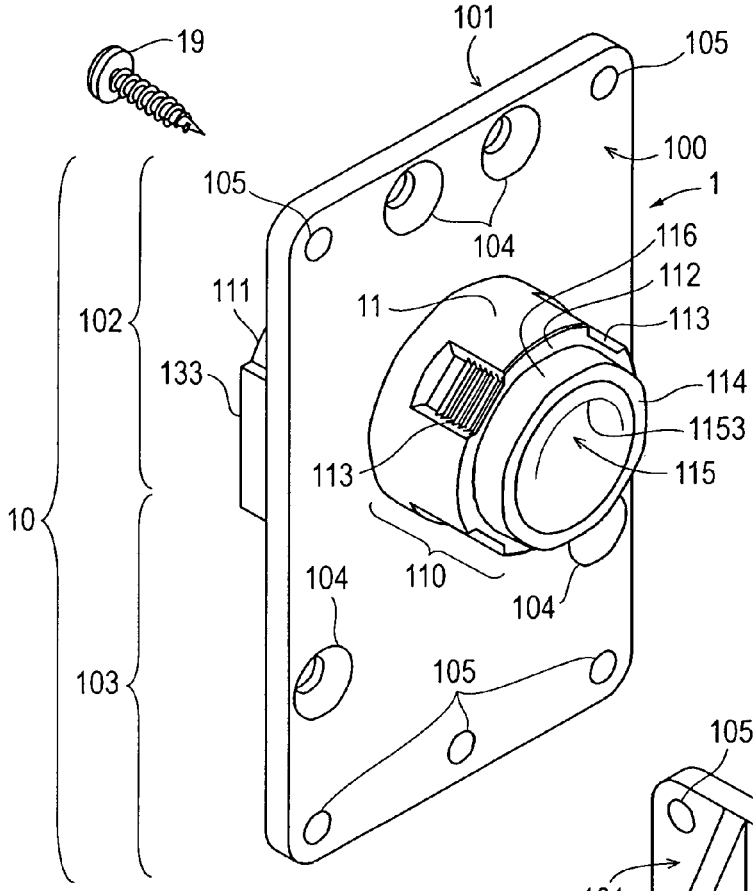
FIG. 2A shows a plug-in sleeve of a first variant with an approached cover ring, in a perspective front view.
Figure 2D:
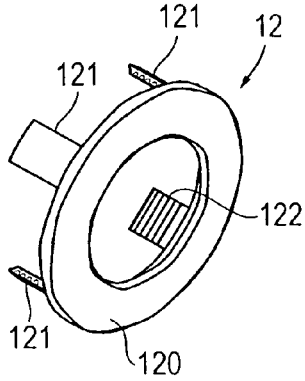
FIG. 2D shows an individual rear plate from FIG. 2C, in a perspective view of the inner side.
Figure 2D:
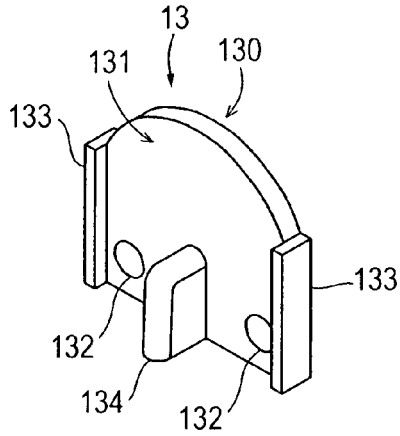
Figure 2B:
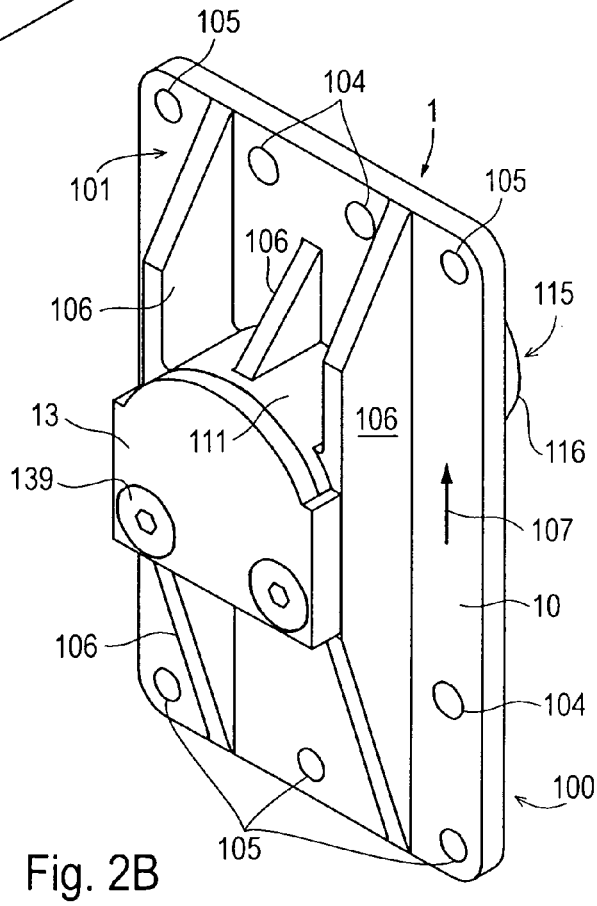
FIG. 2B shows the plug-in sleeve as per FIG. 2A, in a perspective rear view.
Figure 2C:
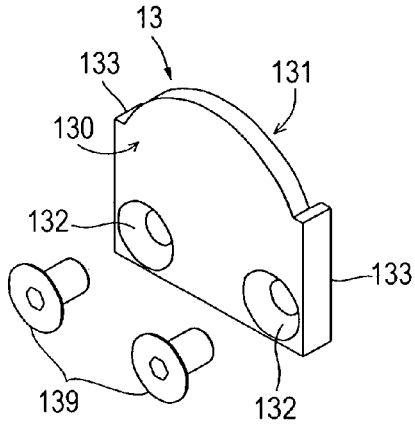
FIG. 2C shows the illustration as per FIG. 2B, with the rear plate released, in a perspective rear view.
Figure 2F:
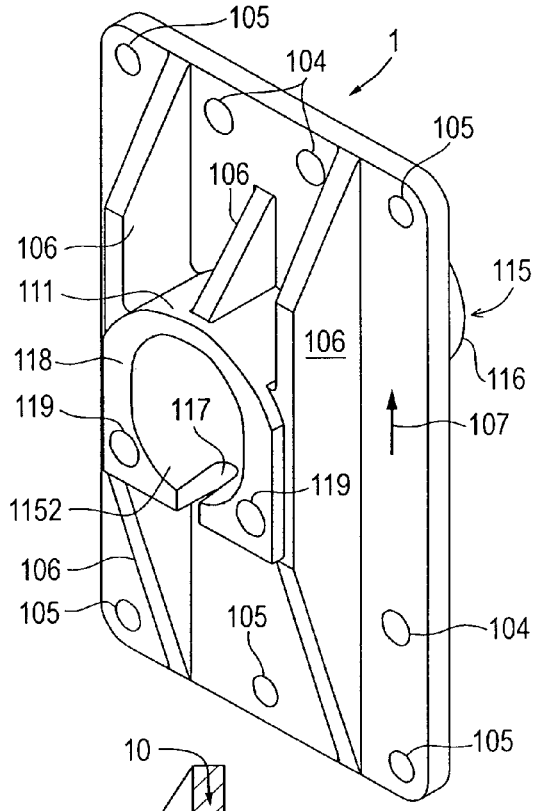
FIG. 2F shows the illustration as per FIG. 2E, with a rear plate, in vertical section.
Figure 2F:
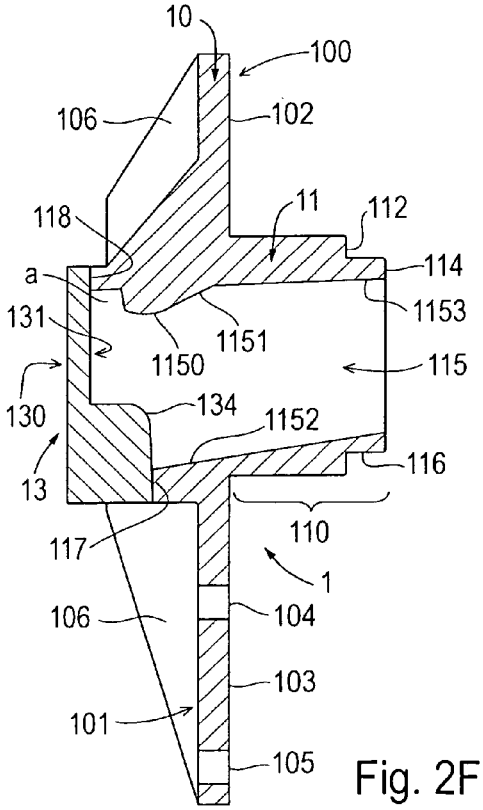
Figure 2E:
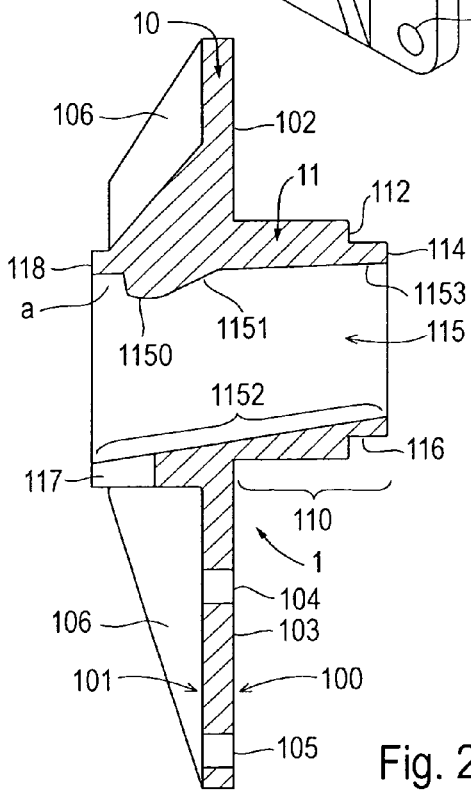
FIG. 2E shows the plug-in sleeve as per FIG. 2A, without a rear plate, in vertical section.

Exemplary embodiments of the hanging device according to the invention are described in detail below with reference to the appended drawings.

The following provision applies to the entire further description. Where reference symbols are contained in a figure for the purpose of clarity of the drawing, but are not explained in the directly associated description text, reference is made to the points where said reference symbols are mentioned in the preceding or subsequent figure descriptions. In the interests of clarity, components are generally not denoted repeatedly in further figures if it can be clearly seen from the drawing that said components are "re-appearing" components.

FIGS. 1A and 1B

The presentation wall configured by way of example is composed substantially of a panel 50, which fulfils the function of a support structure 5, plug-in sleeves 1 which are arranged on said panel in a grid and into which support arms 2 can be inserted in a re-detachable manner, which support arms 2 themselves serve as primary merchandise carriers or support secondary merchandise carriers—for example in the design of shelves 3 or transverse rods 4. In the example shown, the panel 50 is fitted with plug-in sleeves 1 in five columns and two rows, with two rows being without support arms in the present case. The panel 50 is set up vertically, with the plug-in sleeves 1 being mounted from the panel rear side 501, while the support arms 2 and the other merchandise carriers 3,4 project from the panel front side 500 into free space and thus face toward, for example, customers. The horizontally laid-on shelves 3 are usually supported by at least two support arms 2. The support arms 2 can have straight shapes which, in principle, extend horizontally into space or can have other typical shapes such as angled or stepped or provided with a jib 29. At half height, a combined construction is attached, in which two support arms 2 which are positioned adjacent to one another support a shelf 3 and are provided with downwardly extending jibs 29 which carry a transverse rod 4. The free support arms 2 and the transverse rod 4 can be utilized for directly hanging merchandise and the shelves 3 serve for supporting merchandise. The support arms 2 can be easily rearranged within the grid of plug-in sleeves 1, so as to generate a different configuration.

FIGS. 2A to 2F

The plug-in sleeve 1 of the first variant is structured in the flange 10, which lies in a vertical plane, and the sleeve piece 11 which extends horizontally through said flange 10, such that the front section 110 of the sleeve piece 11 extends from the flange front side 100 and the rear section 111 of the sleeve piece 11 extends from the flange rear side 101. For the different fastening types of plug-in sleeve 1, the flange 10 is provided with a plurality of first and second screw holes 104,105 in order to attach screws 19. The position of the sleeve piece 11 divides the flange 10 into an upper part 102 and, situated below the latter, a longer lower part 103, with support fins 106 tapering to the rear section 111 on the flange rear side 101. The end of the rear section 111 is formed by an annular rear face 118 within which emerges the channel 115, which has its inlet on the front section 110. Arranged on the rear face 118 is a rear plate 13 which is fastened by means of screws 139, which rear plate 13 closes off the outlet of the channel 115. For this purpose, threaded blind holes 119 are provided in the rear face 118. The outer side 130 of the rear plate 13 is, in principle, smooth, whereas on the inner side 131 a second locking contour 134 which projects in the manner of a lug is provided at the bottom in the centre. Situated at both sides of the locking contour 134 are in each case one hole 132 for the lead-through of the screws 139 and in each case one vertical flange web 133 for engaging laterally around an edge zone of the rear section 111 of the sleeve piece 11. At the bottom in the centre, a notch 117 extends from the rear face 118 into the rear section 111, such that the second locking contour 134 is located in sections in the notch 117 when the rear plate 13 is mounted. A directional mark 107 on the flange rear side 101 denotes the prescribed alignment of the plug-in sleeve 1 during assembly.

The front section 110 of the sleeve piece 11 ends at the front with a collar 116 which terminates with an annular face 114, which lies in the vertical plane, and borders an opening which is circular in principle and which forms the inlet of a channel 115 which extends axially with varying geometry through the entire interior of the sleeve piece 11. A first locking contour 1150 extends into the channel 115 from above at a distance from the rear face 118. Proceeding from the front-side inlet of the channel 115, a run-on portion 1151 in the manner of an inclined plane is positioned upstream of the locking contour 1150. In the direction of the rear face 118, the channel 115 has a downwardly inclined widening 1152, as a result of which the channel 115 has a cross section which—aside from a play 1153—is circular in principle at the inlet, while the clear height increases in the direction of the rear face 118.

Figure 6A:
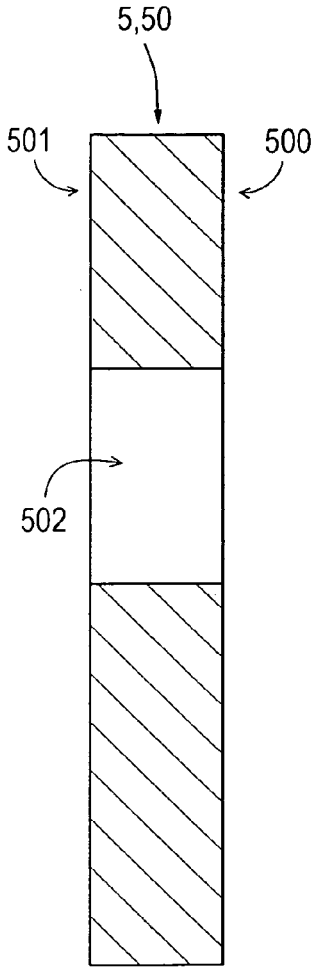
FIG. 6A shows a panel as a support structure with a passage hole of the second variant for receiving a plug-in sleeve as per FIG. 2A, in vertical section.
Figure 6B:
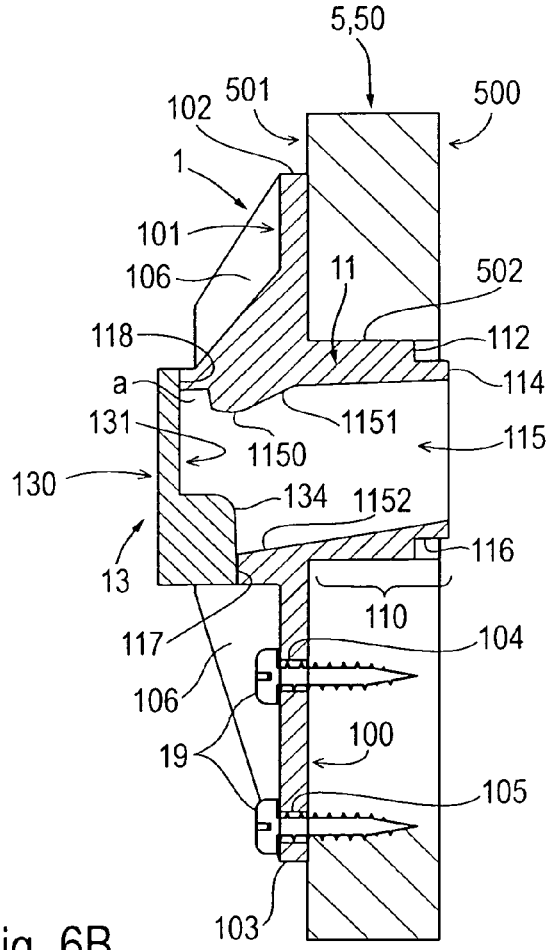
FIG. 6B shows a plug-in sleeve as per FIG. 2F inserted into a panel with a passage hole as per FIG. 6A, in vertical section.
Figure 6C:
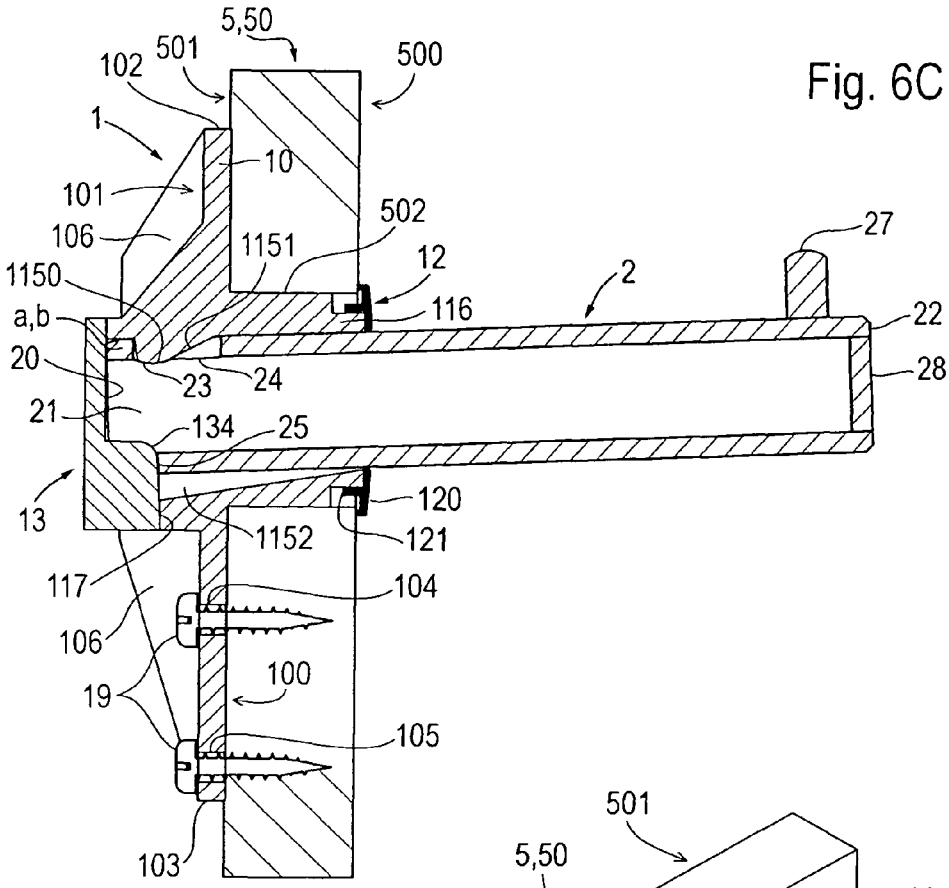
FIG. 6C shows the arrangement as per FIG. 6B, with the support arm as per FIG. 3A inserted, in the locked, final position and with the cover ring from FIG. 2A latched on, in a vertical longitudinal section.
Figure 6D:
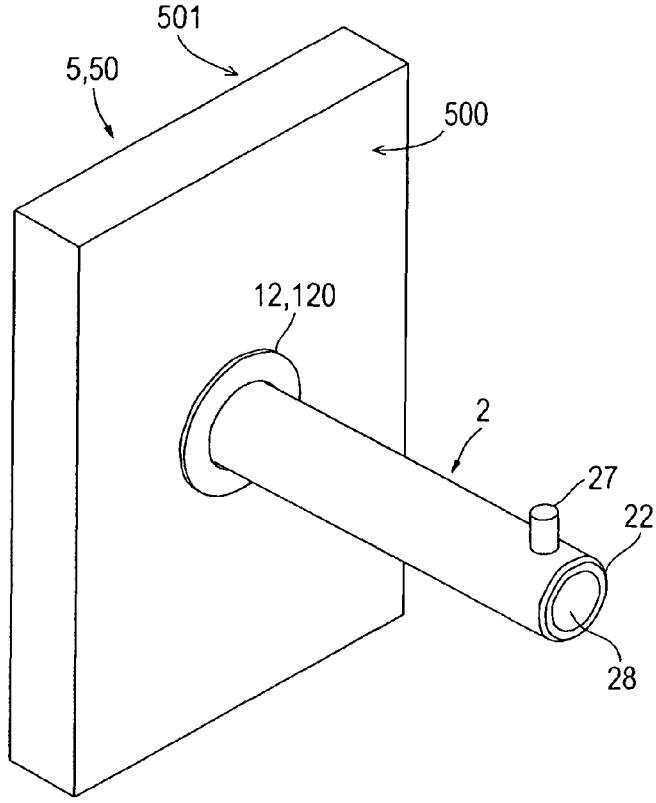
FIG. 6D shows the arrangement as per FIG. 6C, in a perspective front view.
Figure 7A:
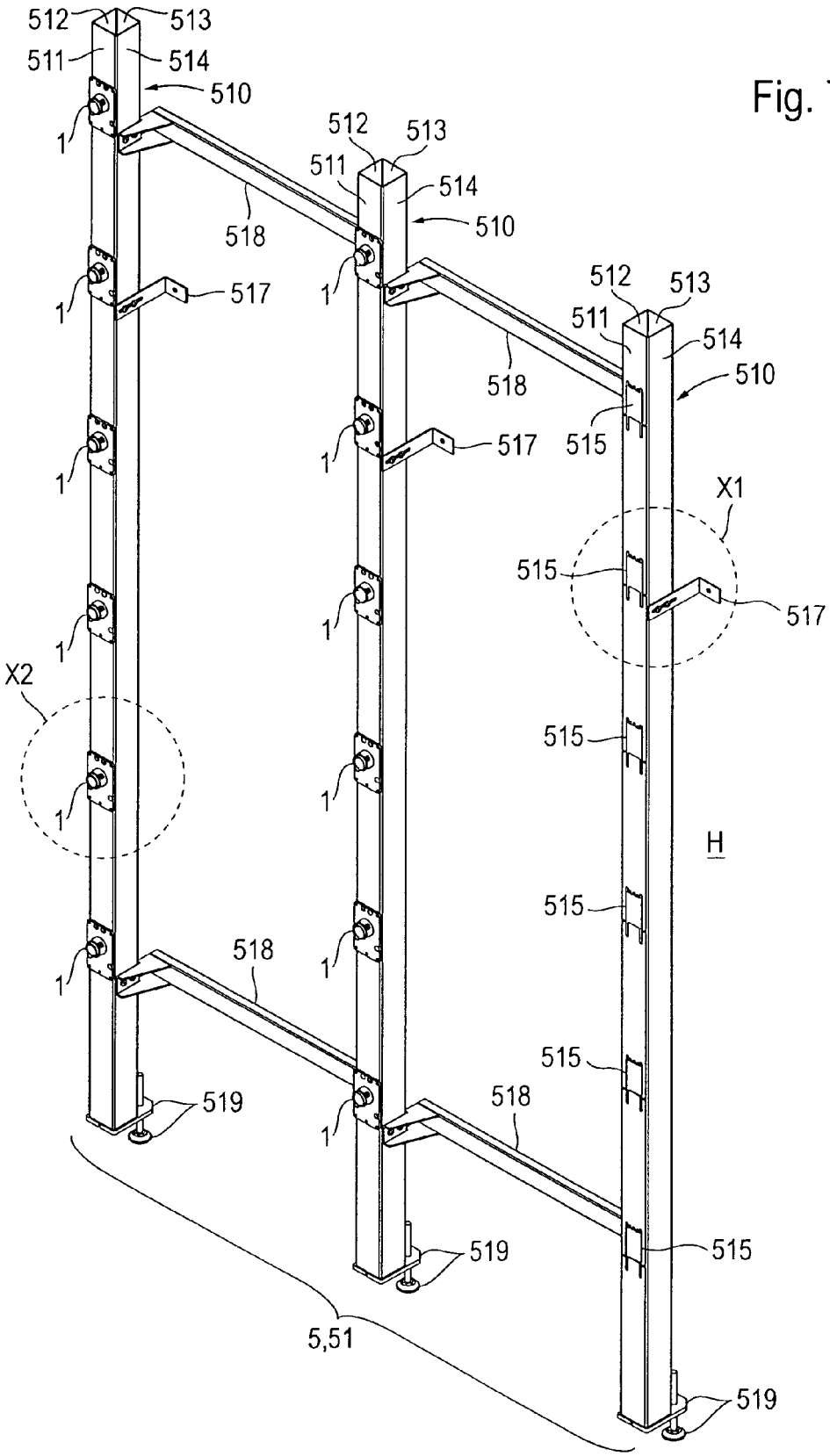
FIG. 7A shows a sub-construction composed of vertical pillars and transverse connectors as a supporting structure, systematically fitted with plug-in sleeves as per FIG. 2A, in a perspective front view.
Figure 7B:
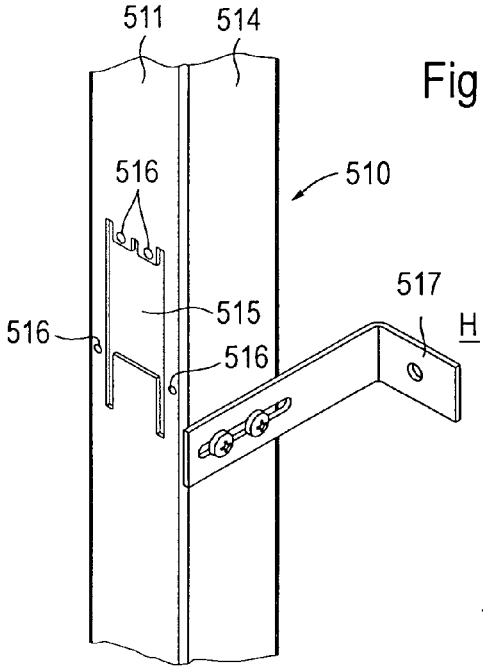
FIG. 7B shows the enlarged detail X1 from FIG. 7A.
Figure 7C:
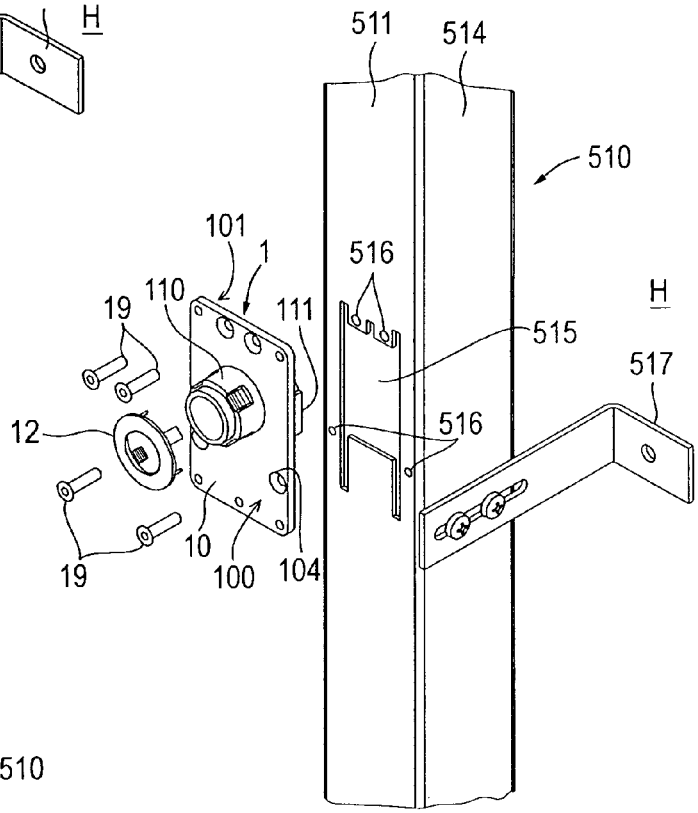
FIG. 7C shows the arrangement as per FIG. 7B, with the approached plug-in sleeve and cover ring as per FIG. 2A.
Figure 7D:
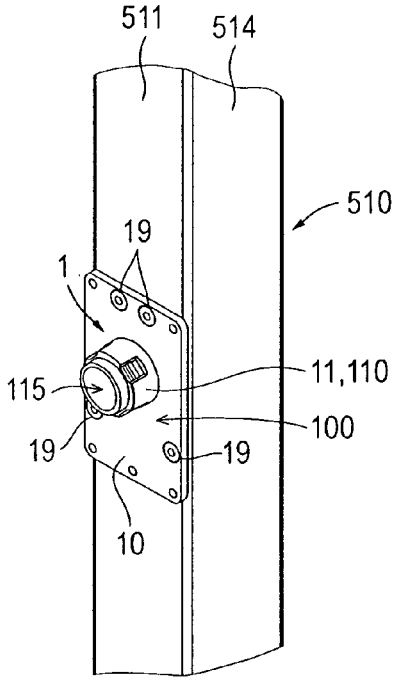
FIG. 7D shows the enlarged detail X2 from FIG. 7A.
Figure 7E:
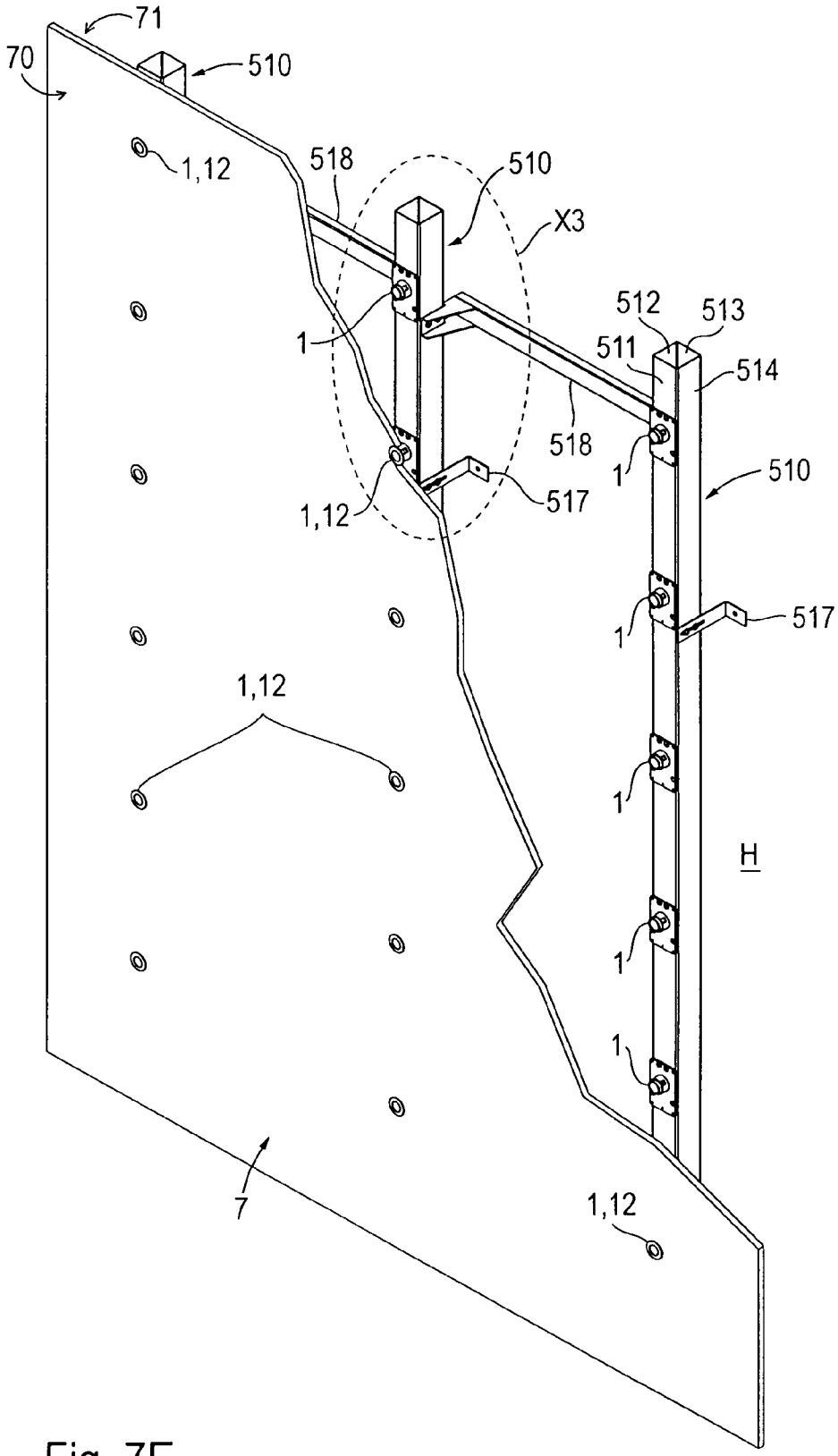
FIG. 7E shows the arrangement as per FIG. 7A, completely fitted with plug-in sleeves as per FIG. 2A, with a cover plate positioned in front and with cover rings latched on, in a perspective front view.
Figure 7G:
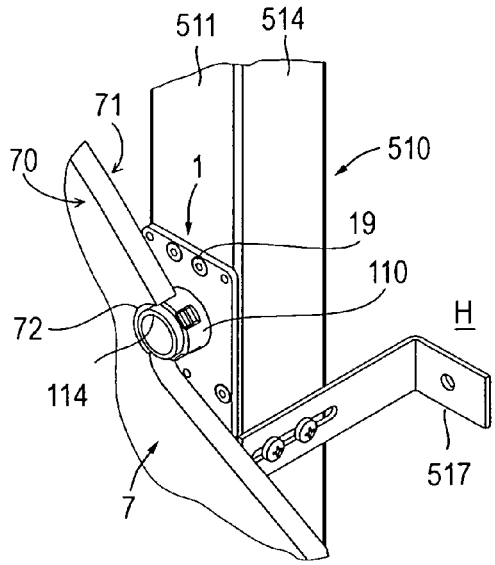
FIG. 7G shows the detail X4 from FIG. 7F.
Figure 7F:
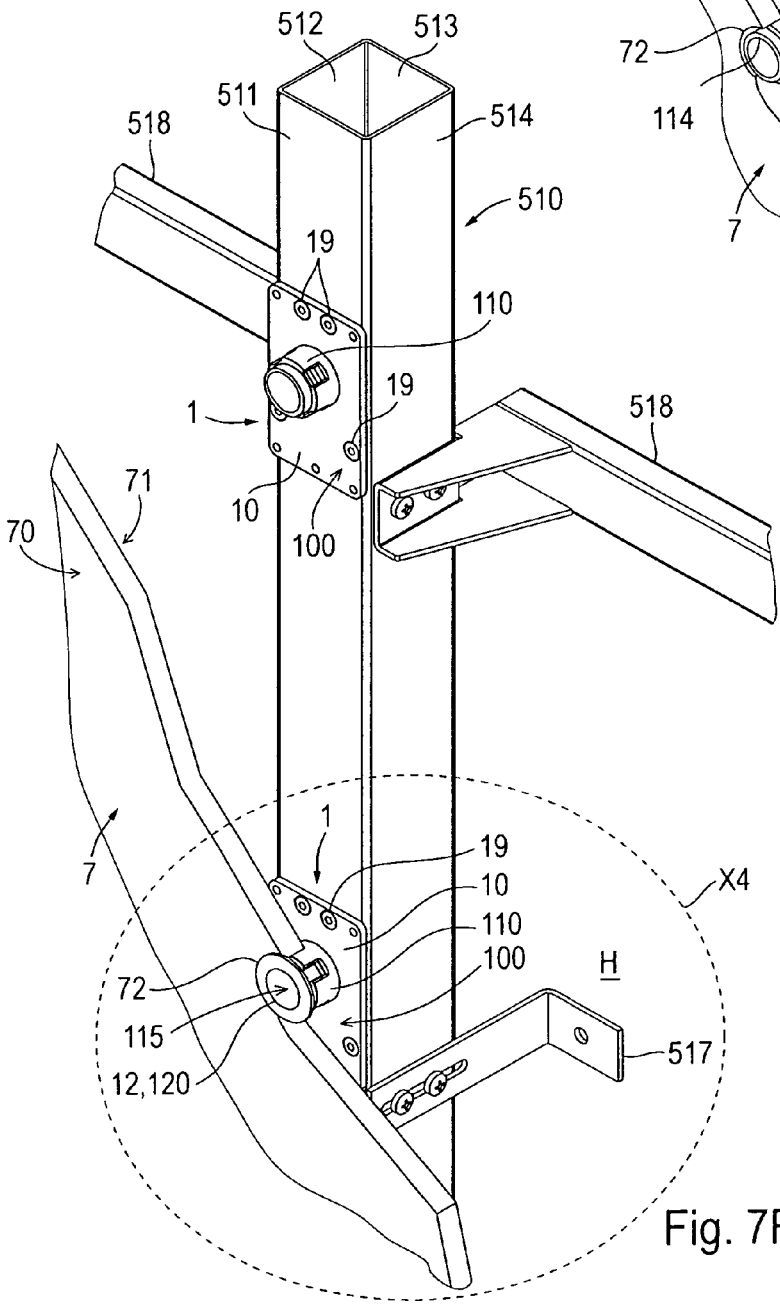
FIG. 7F shows the enlarged detail X3 from FIG. 7E.
Figure 8A:
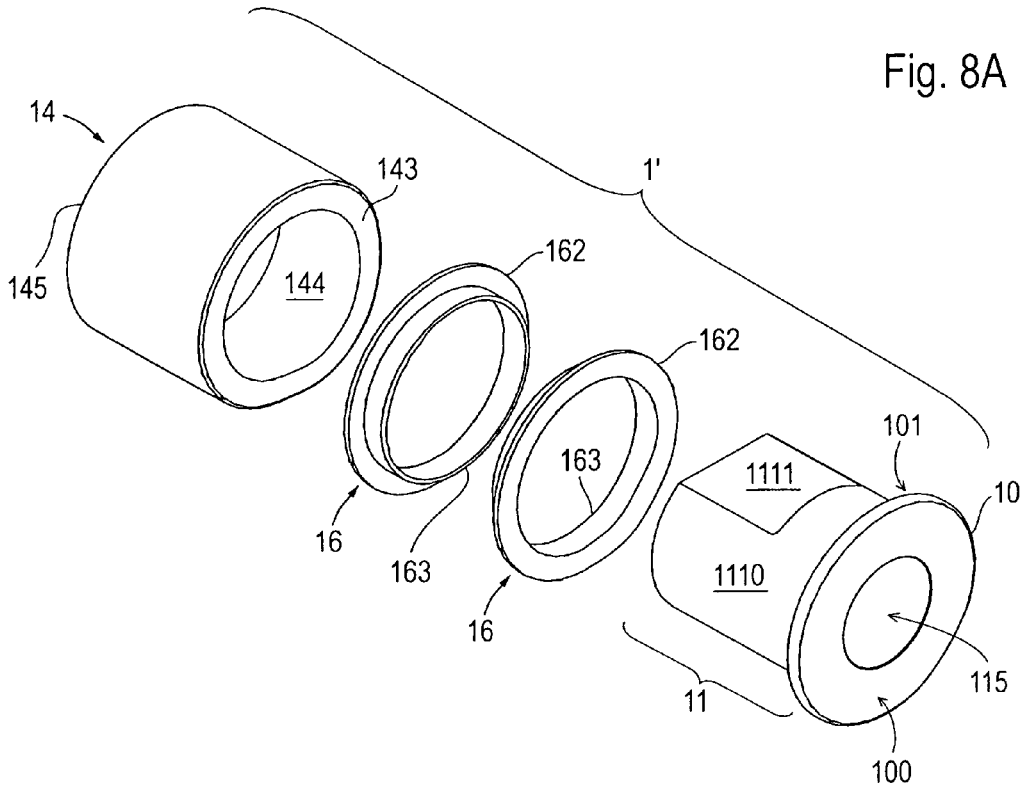
FIG. 8A shows a plug-in sleeve of the second variant, in a perspective exploded view.
Figure 8B:
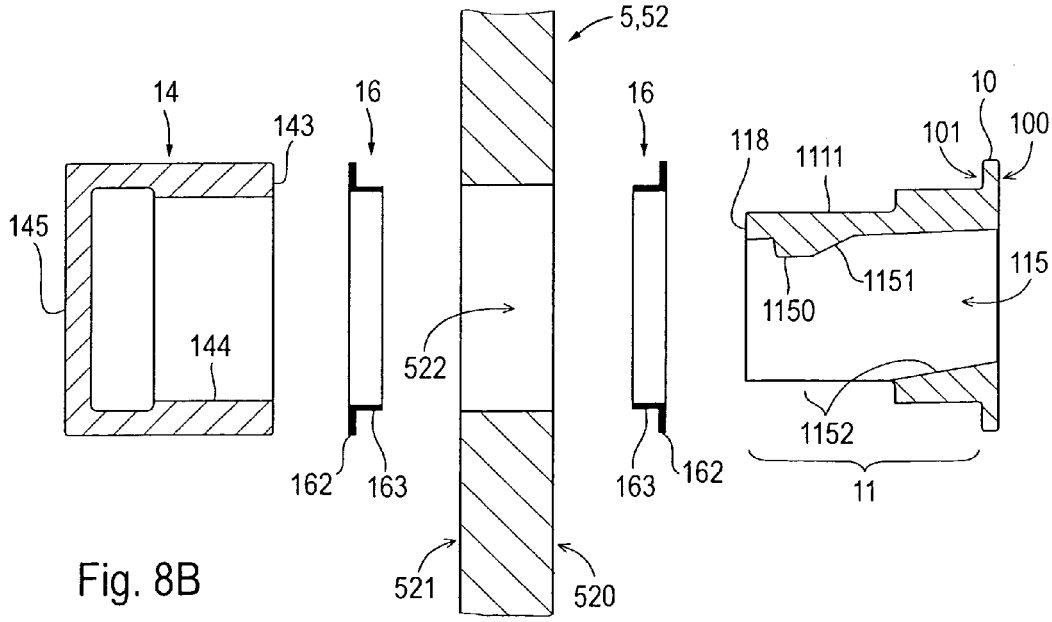
FIG. 8B shows the plug-in sleeve as per FIG. 8A, with a vertical plate inserted, in a vertical longitudinal section.
Figure 8C:
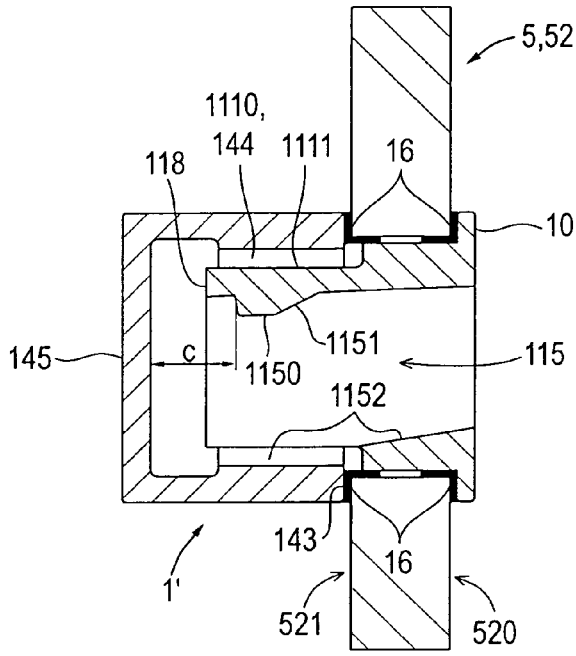
FIG. 8C shows the arrangement as per FIG. 8B, assembled, in a vertical longitudinal section.
Figure 8D:
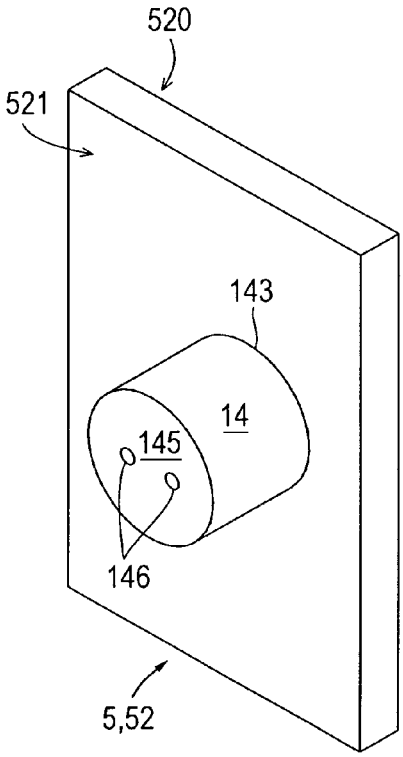
FIG. 8D shows the arrangement as per FIG. 8C, in a perspective rear view.
Figure 9D:
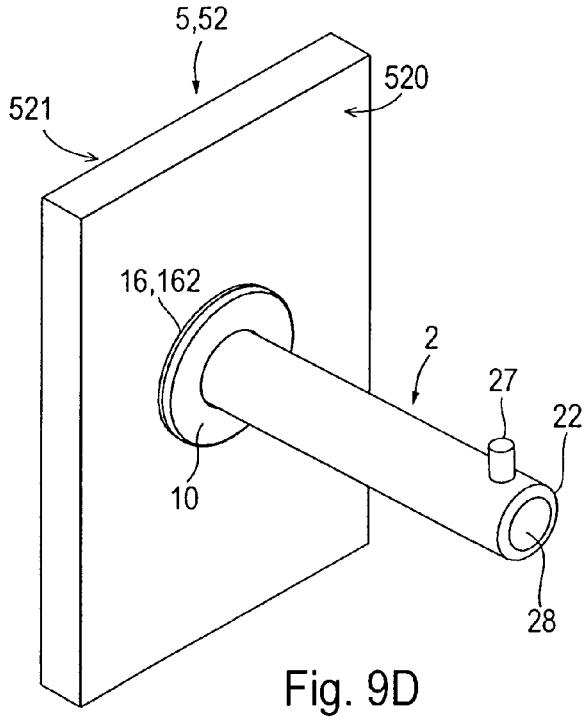
FIG. 9D shows the arrangement as per FIG. 9C, in a perspective front view.
Figure 9A:
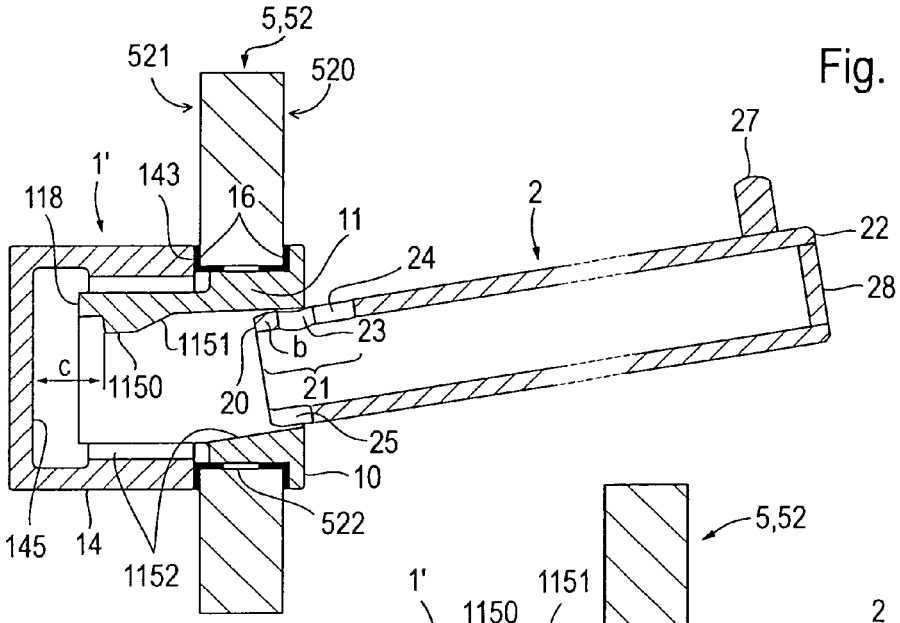
FIGS. 9A to 9C show the second to fourth phases of the hooking of a support arm into a plug-in sleeve of the second variant as per FIG. 8A, in each case in a vertical longitudinal section.
Figure 9B:
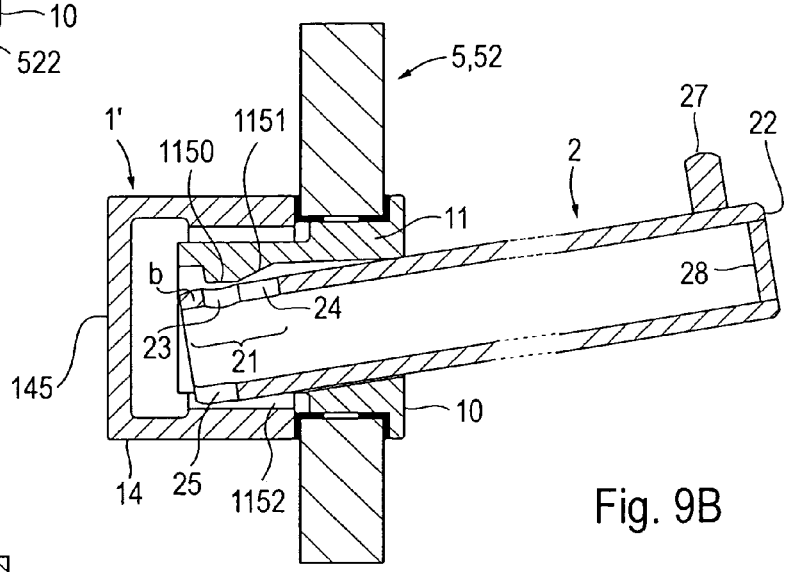
Figure 9C:
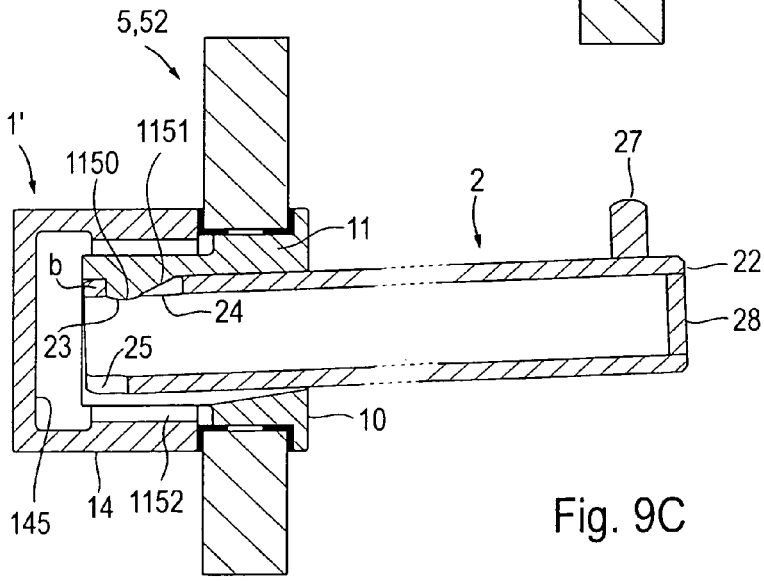

In the direction of the flange front side 100, the collar 116 merges into an annular shoulder 112 which extends parallel to the annular face 114. Downstream of the annular shoulder 112, the front section 110 continues, widened in outer diameter, up to the opening-out point on the flange front side 100, and has a plurality of radially uniformly distributed latching contours 113. For a certain installation situation (see FIG. 6C), a cover ring 12 is provided, whose disc part 120, in the mounted state, comes to rest on the panel front side 500 and whose webs 121 engage with their inner latching face 122 into the latching contours 113 and thereby hold the cover ring 12 in position.

Figure 3A:
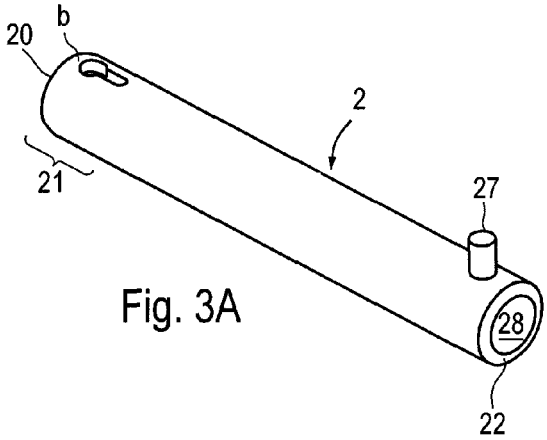
FIG. 3A shows a support arm in a perspective front view.
Figure 3B:
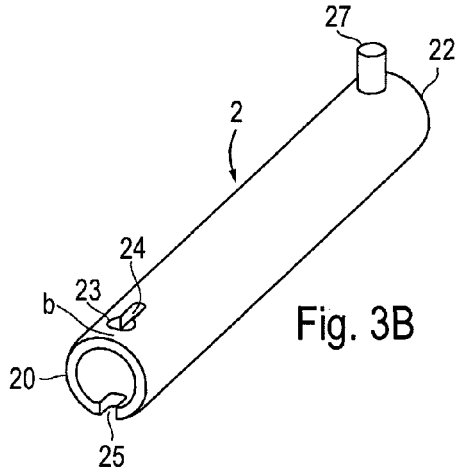
FIG. 3B shows the support arm as per FIG. 3A, in a perspective rear view.
Figure 3C:
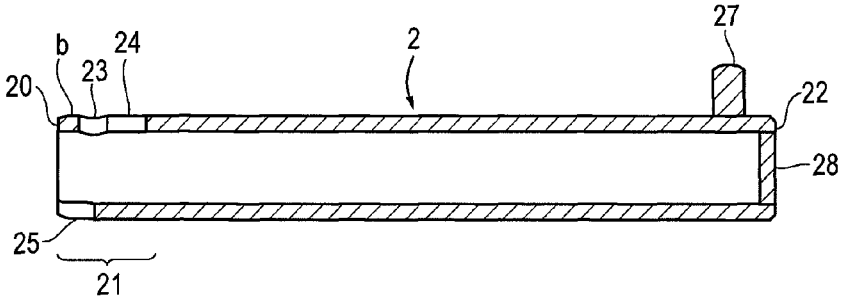
FIG. 3C shows the support arm as per FIG. 3A, in a vertical longitudinal section.
Figure 3D:
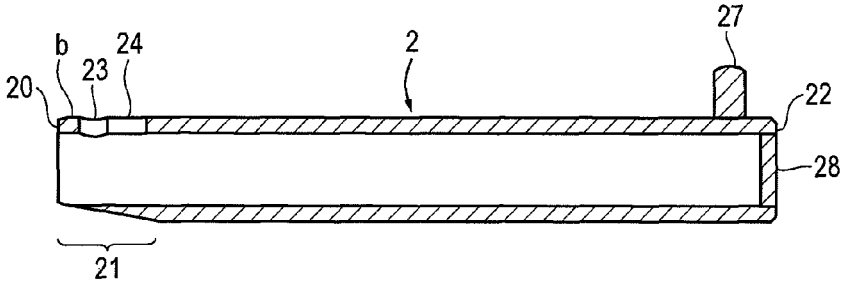
FIG. 3D shows an embodiment of the support arm in a vertical longitudinal section.
Figure 3E:
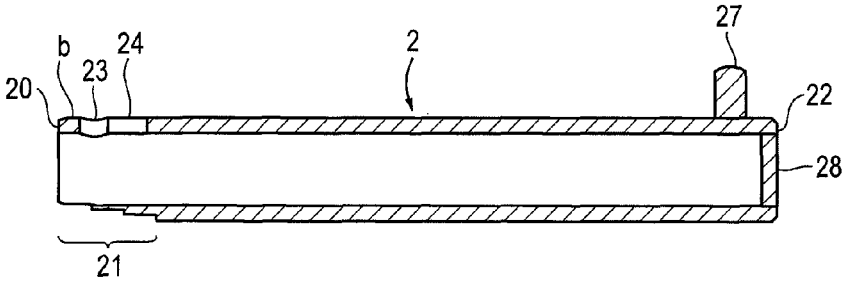
FIG. 3E shows another embodiment of the support arm in a vertical longitudinal section.

FIGS. 3A to 3C

The support arm 2, which is for example of straight design, is composed substantially of a tube piece which is round in cross section and which extends between a plug-in end 20 and a front end 22. Situated on the side of the plug-in end 20 is the plug-in section 21, while the front end 22 is provided with a closure 28 and typically has an upwardly projecting holding pin 27 which prevents articles which are hanging on the support arm 2, in particular clothing hangers, from sliding off. A hole 23 is situated within the plug-in section 21 in its upper region with an offset b with respect to the plug-in end 20, which hole 23 merges in the manner of a keyhole into a hole projection 24 which extends axially in the direction of the front end 22. Situated in the lower region of the plug-in section 21, approximately opposite the hole combination 23,24, is a groove 25 which runs in the direction of the front end 22 and which opens out in the direction of the plug-in end 20.

FIGS. 4A to 4D

This sequence of figures shows the functional principle of the hanging device composed of the plug-in sleeve 1 and support arm 2 on the basis of the four characteristic phases when hooking the support arm 2 into the plug-in sleeve 1. The removal of a support arm 2 which is seated with its plug-in section 21 in the locked, final position in the plug-in sleeve 1 takes place in the reverse sequence.

Figure 4A:
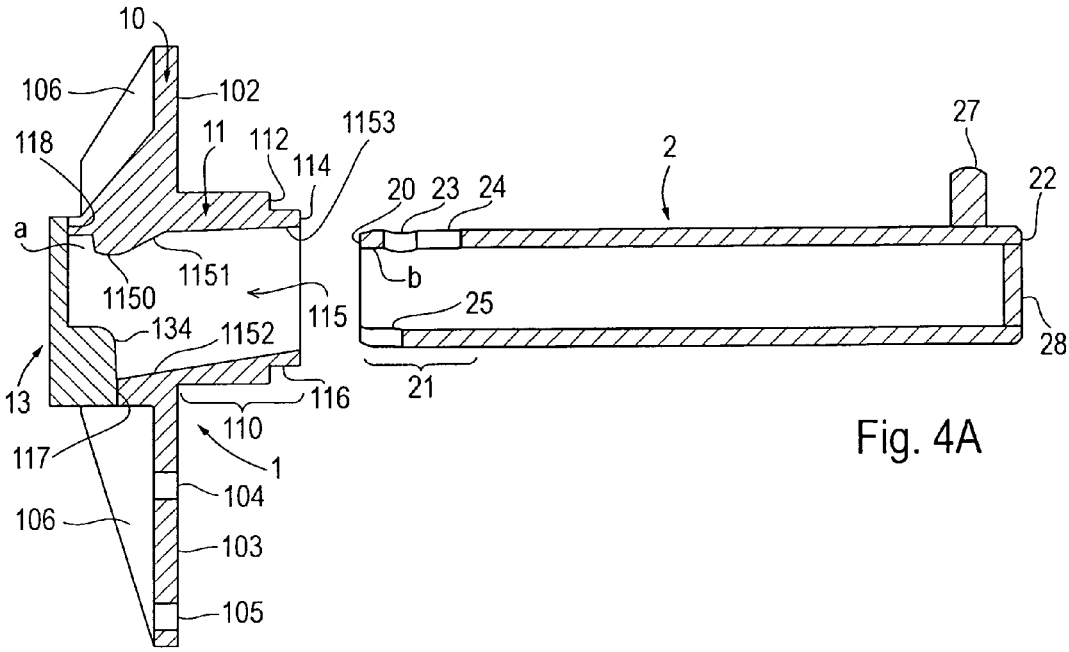
FIGS. 4A to 4D show the first to fourth phases of the hooking of a support arm into a plug-in sleeve of the first variant as per FIG. 2A, in each case in a vertical longitudinal section.

FIG. 4A (First Hooking-in Phase)

The channel 115 of the plug-in sleeve 1 with the upper play 1153, the first locking contour 1150 and the run-on portion 1151 which is positioned upstream of said first locking contour 1150, and the widening 1152 and the second locking contour 134 is initially unoccupied, with the inlet into the channel 115 until now opening out freely into space. If it is intended to insert a support arm 2 into the plug-in sleeve 1, the support arm 2 must be moved successively closer to the channel 115 so as to be aligned axially with respect to, and facing with the plug-in end 20 toward, the channel 115. Here, the combination of the holes 23,24 should be positioned at the top and the groove 25 should be positioned vertically below said holes 23,24.

Figure 4B:
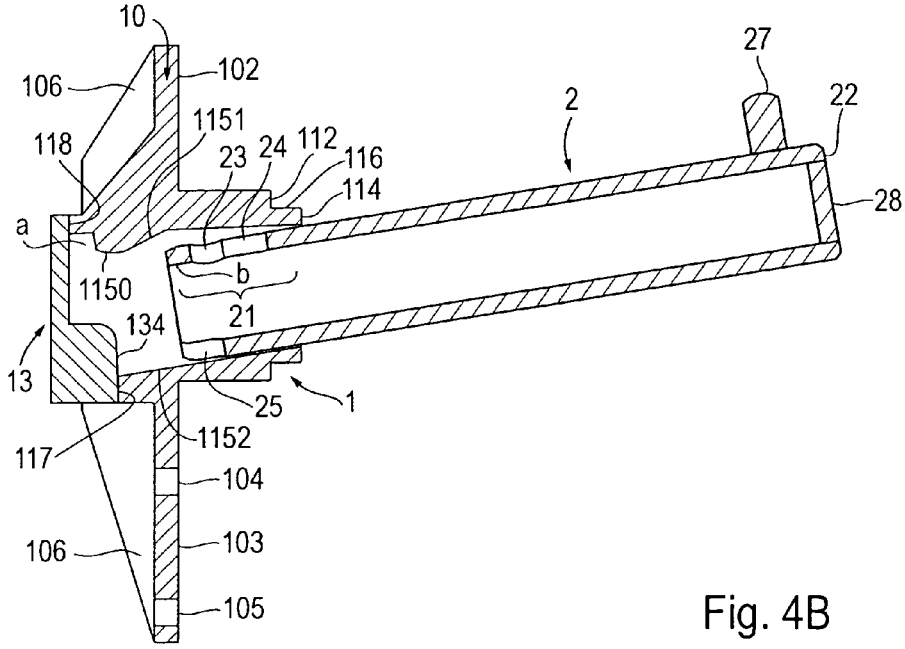

FIG. 4B (Second Hooking-in Phase)

The plug-in section 21 is firstly inserted in sections into the inlet of the channel 115, with it being possible for the support arm 2 to still be approximately in a horizontal alignment or, in an anticipatory fashion, with its front end 22 already obliquely raised. The oblique position is permitted by the upper play 1153. At present, the hole combination 23, 24 on the support arm 2 is still entirely out of engagement with the first locking contour 1150 and its run-on portion 1152 in the plug-in sleeve 1, and at the same time, the groove 25 on the plug-in section 21 and the second locking contour 134 of the plug-in sleeve 1 are still remote from one another. With further insertion of the plug-in section 21 into the channel 115, a support arm 2 still aligned largely horizontally would impact with the upper region of its plug-in section 21 against the run-on portion 1151 and thereby be moved increasingly into the inclined position.

Figure 4C:
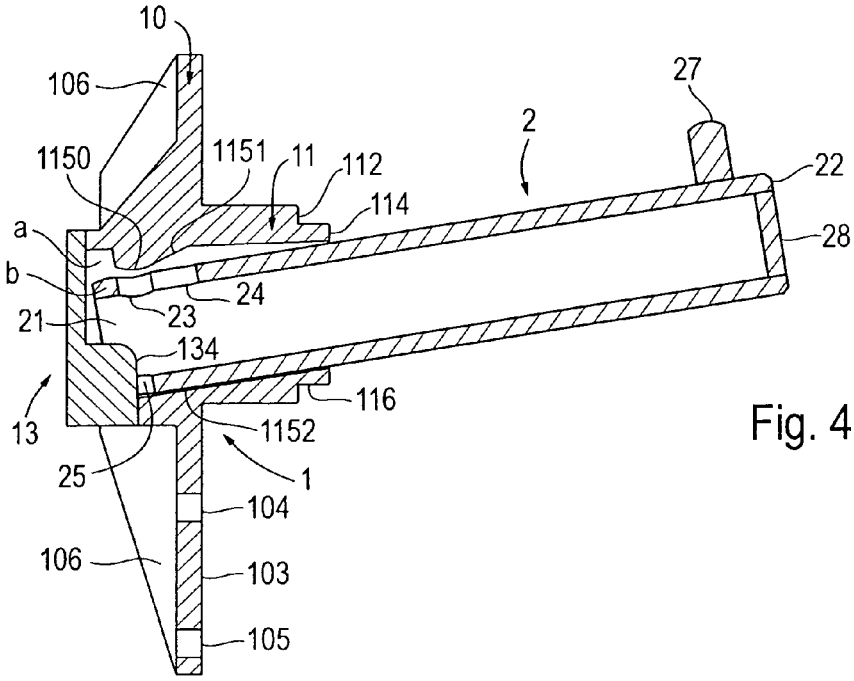

FIG. 4C (Third Hooking-in Phase)

With increasing inclination of the support arm 2, the plug-in section 21 passes into the maximum possible insertion depth into the channel 115 until the plug-in end 20 impacts against the inner side 131 of the rear plate 13, the second locking contour 134 has moved into the groove 25 and the first locking contour 1150 is situated with the run-on portion 1151 congruently over the hole combination 23,24.

Figure 4D:
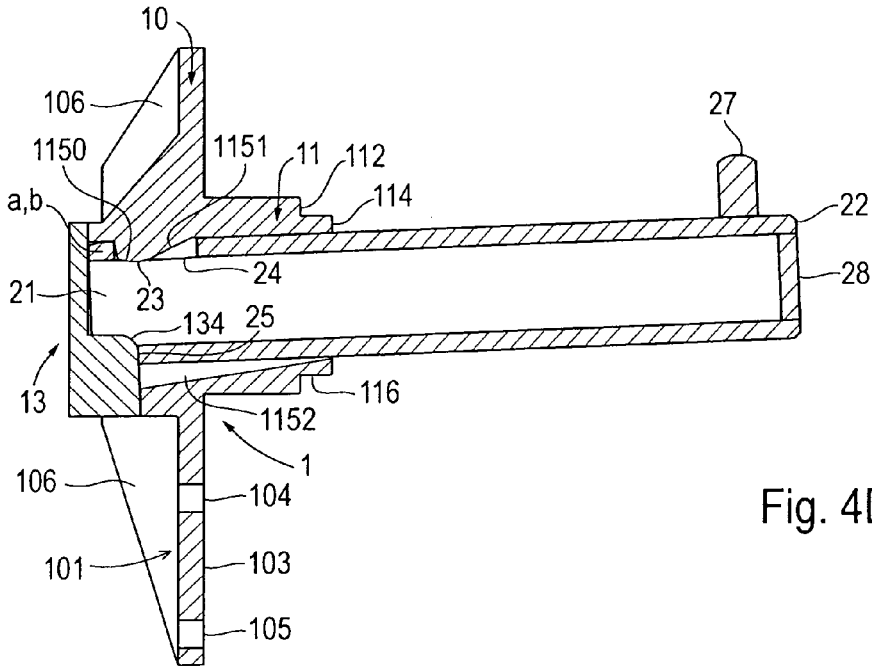
Figure 5A:
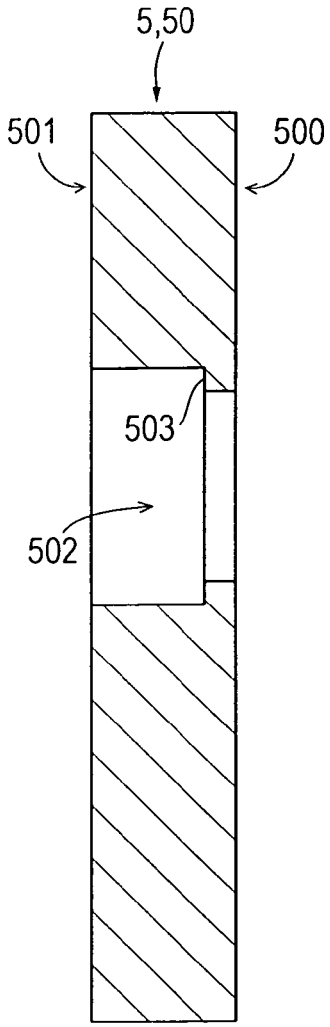
FIG. 5A shows a panel as a supporting structure with a passage hole of the first variant with an annular shoulder arranged therein for receiving a plug-in sleeve as per FIG. 2A, in vertical section.
Figure 5B:
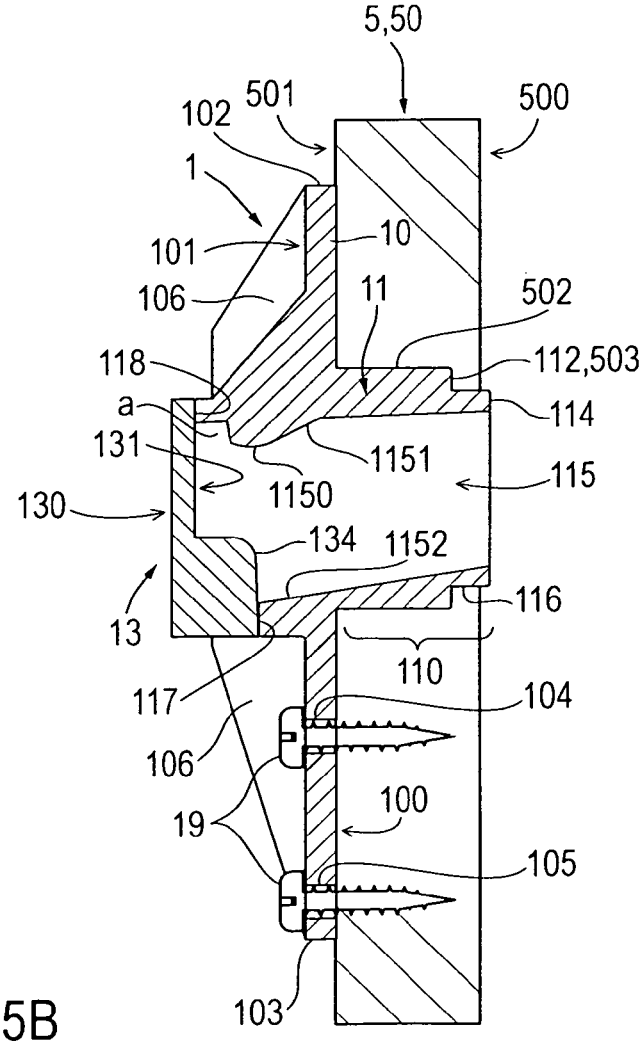
FIG. 5B shows a plug-in sleeve as per FIG. 2F inserted into a panel with a passage hole as per FIG. 5A, in vertical section.
Figure 5D:
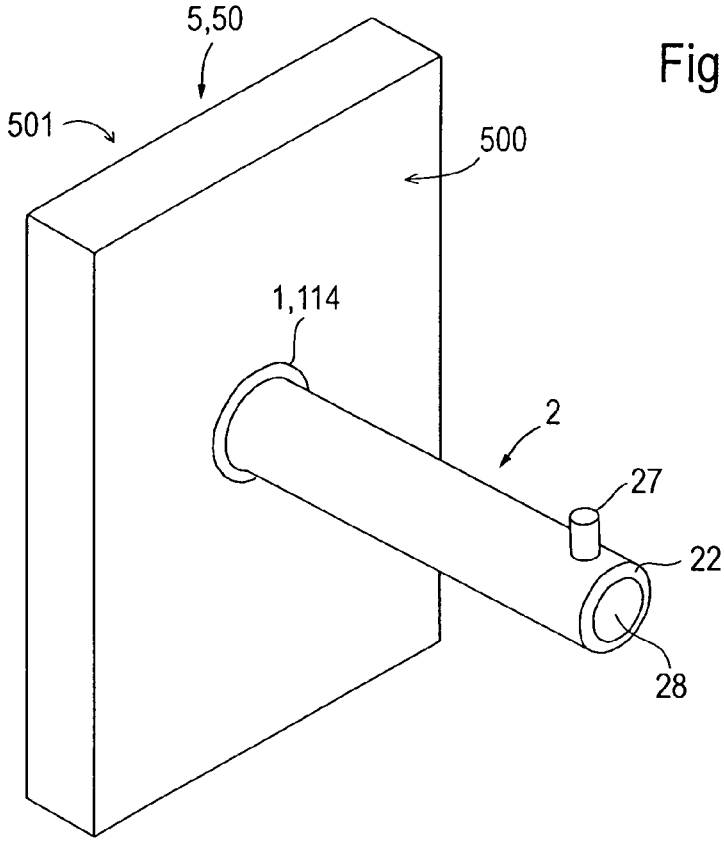
FIG. 5D shows the arrangement as per FIG. 5B, with the support arm as per FIG. 3A inserted, in a perspective front view.
Figure 5C:
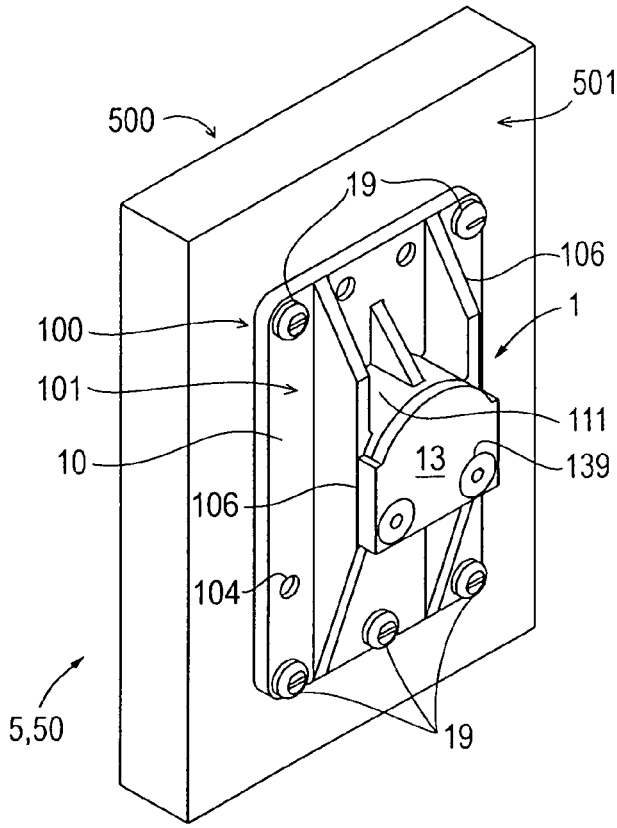
FIG. 5C shows the arrangement as per FIG. 5B, in a perspective rear view.

FIG. 4D (Fourth Hooking-in Phase)

After reaching the third hooking-in phase (see FIG. 4C), the support arm 2 is pivoted into the horizontal position. The second locking contour 134 thereby moves more completely into the groove 25 and the first locking contour 1150 with the run-on portion 1151 move into the hole combination 23,24, with the upper region of the plug-in section 21 abutting against the roof surface in the channel 115. The widening 1152 now forms an approximately wedge-shaped air gap. As a result of the engagement of the first locking contour 1150 in the hole 23, the support arm 2 is now in the locked, final position and cannot be pulled out axially without the locking between the first locking contour 1150 and hole 23 being released by obliquely raising the support arm 2. The interaction between the second locking contour 134, which is seated in sections in the groove 25, has the sole function of additional rotation prevention for the inserted support arm 2, with the engagement of the first locking contour 1150 with the run-on portion 1151 and the hole combination 23,24 also providing an anti-twist action. A double rotation-prevention arrangement increases the stability in particular if an asymmetrically loaded secondary merchandise carrier, for example a shelf 3, rests on a single support arm 2.

FIGS. 5A to 5D

In this application, the support structure 5 used is a panel 50 which has a passage hole 502 of the first variant for holding the plug-in sleeve 1, that is to say, close to the panel front side 500, the passage hole 502 has an annular shoulder 503, upstream of which the diameter of the hole 502 is reduced. In the installed state, the annular shoulder 112 of the sleeve piece 11 abuts against the annular shoulder 503, with the entire front section 110 being inserted in the passage hole 502. The frontal annular face 114 comes to rest, in principle, in the plane of the panel front side 500. The flange front side 100 is seated on the panel rear side 501, with the flange 10 being screwed to the panel 50 by means of screws 19 through the screw holes 104 and/or 105. The front section 110 of the sleeve piece 11 with the annular shoulder 112 and the collar 116 is located in a form fitting and, in principle, gapless manner in the complementarily shaped passage hole 502. An inserted support arm 2 is surrounded by the annular face 114 and projects freely into space, such that merchandise can be hung directly thereon—in the function as a primary merchandise carrier—or secondary merchandise carriers, for example shelves 3, can be supported thereon.

FIGS. 6A to 6D

Here, too, the support structure 5 used is a panel 50 which now, however, has a passage hole 502 of the second variant for holding the plug-in sleeve 1, which passage hole 502 is continuously cylindrical, that is to say is designed so as to be unchanging in diameter. In the installed state, an annular gap which runs around the collar 116 remains upstream of the annular shoulder 112 in the passage hole 502, which annular gap is visible from the panel front side 500. The formation of a simple passage hole 502 of the second variant is less complex than that of a passage hole of the first variant. In order to visually screen the open annular gap, the covering ring 12 is placed on, the webs 121 of which cover ring 12 engage into the latching contours 113 on the front section 110 of the sleeve piece 11. The disk part 120 of the cover ring 12 closes off the annular gap and is seated on the annular face 114 and on the edge which, on the panel front side 500, surrounds the opening-out point of the passage hole 502. The cover ring 12 can advantageously be produced as a plastic injection-molded part. An inserted support arm 2 is now visually bordered by the cover ring 12.

FIGS. 7A to 7G

In a further application the support structure 5 used for holding the plug-in sleeves 1 is a sub-construction 51 which is constructed for example from three vertical pillars 510 which are set up in a plane in front of a rear-side background H and at systematic intervals. In each case a plurality of transverse connectors 518 are advantageously inserted between adjacent vertical pillars 510, and a plurality of angled retainers 517 serve as a connection between the vertical pillars 510 and the background H. Seated on the ground are feet 519 which are arranged on the lowermost point on the vertical pillars 510. A vertical pillar 510 is preferably a hollow profile which is square in cross section and has a first outer face 511 which is aligned forward, the second outer face 512 which adjoins said first outer face 511 and is aligned to the side, the rearwardly aligned third outer face 513 and the fourth outer face 514 which adjoins said third outer face 513 and is aligned to the other side. The transverse connectors 518 are fastened in each case to the second and fourth outer faces 512,514 of adjacent vertical pillars 510. The transverse connectors 518 serve to stabilize the frame assembly and provide that an intended spacing between the vertical pillars 510 is adhered to. The retainers 517 are advantageously attached at one side to the fourth outer faces 514 and at the other side to the background H.

A plurality of cut-outs 515 which are arranged in a grid and which have a rectangular outline in principle are provided in the first outer face 511 which is aligned forward. Said cut-outs 515 provide access into the interior cavity of the vertical pillar 510. A plurality of slots extend from the individual cut-out 515, and screw holes 516 are provided adjacent to said cut-out 515. It is possible to insert plug-in sleeves 1 into the cut-outs 515, the flange rear sides 101 of which plug-in sleeves 1 come to rest on the first outer faces 511 and the rear sections 111 of the sleeve piece 11 of which plug-in sleeves 1 project through the cut-outs 515 into the vertical pillars 510. The support ribs 106 on the flange rear side 101 are located in the slots which extend from the cut-out 515. The fastening of the plug-in sleeves 1 takes place by means of screws 19 which engage for example through the first screw holes 104 in the flange 10 into the screw holes 516 of the vertical pillar 510. The front sections 110 of the plug-in sleeves 11 initially project freely from the flange front sides 100 into space.

The construction which is erected in this way is now lined with a facing plate 7 whose rear side 71 abuts against the flange front sides 100. For the lead-through of the front section 110 of the sleeve pieces 11, congruently positioned holes 72 are provided in the facing plate 7. For visually clean coverage of the edges of the holes 72 on the front side 70, cover rings 12 are pushed onto the latching contours 113 of the front sections 110. The inlets of the channels 115 of the plug-in sleeves 1 are thereby prepared for the insertion of support arms 2.

FIGS. 8A to 8D

This pair of figures illustrates a modified plug-in sleeve 1' of the second variant for installation in a support structure 5 composed of special vertical plates 52, which are composed for example of glass. At the foremost end, the plug-in sleeve 1' has a flange 10 which is designed as a circular ring and on the front side 100 of which the channel 115 enters. The entire sleeve piece 11 extends from the flange rear side 101, which sleeve piece 11 is provided with a radially encircling external thread 1110 and has, at the top, an external flattening 1111 whose position indicates the intended rotational position of the plug-in sleeve 1' during assembly. Opposite the flattening 1111, the sleeve piece 11 is open. To the rear, the sleeve piece 11 ends again with the rear face 118, and the same first locking contour 1150 with the run-on portion 1151 are provided at the inside. Adjoining the flange 10, the widening 1152 likewise runs initially obliquely downward and is then generated, in the direction of the rear face 118, by the lower open region on the sleeve piece 11.

In particular when inserting the plug-in sleeve 1' into a vertical plate 52 composed of brittle material, such as for example a glass plate, it is expedient to use, in each case on the front and rear sides 520,521, a cuff 16 which borders the passage hole 522. The cuff 16 has an angled profile in cross section and is composed of an annular segment 162 and a cylindrical segment 163. For securing a plug-in sleeve 1' which is inserted into a passage hole 522, a cap-like cap nut 14 is provided which has a base 145 and, at the inside, an internal thread 144 which is designed to interact with the external thread 1110. Opposite the base 145, the cap nut 14 ends with an annular shoulder 143.

In the assembled state, the annular segments 162 of the two cuffs 16 come to rest against the front and rear sides 520,521 of the vertical plate 52, while the cylindrical segments 163 of the cuffs 16 project into the passage hole 522 so as to be aligned toward one another. The flange 10 is positioned on the front side 520 and the sleeve piece 11 extends through the passage hole 522 and projects beyond the rear side 521. The cap nut 14 which is screwed onto the sleeve piece 11 is in engagement, with its thread 144, with the external thread 1110, and the annular shoulder 143 is seated on the annular segment 162 of the adjacent cuff 16. Here, the free space c is generated from the first locking contour 1150 to the inner side of the base 145, and the widening 1152 which extends up to the inner wall of the cap nut 14 is generated. For the engagement of a screwing tool onto the cap nut 14, an externally accessible engagement contour 146 is provided on the base 145.

FIGS. 9A to 9D

The phased profile during the hooking of a support arm 2 into the plug-in sleeve 1' of the second variant is largely identical to the hooking-in principle with a plug-in sleeve 1 of the first variant as per FIGS. 4A to 4D. The approaching as per the first hooking-in phase and the insertion, in sections, of the plug-in section 21 in the second hooking-in phase (see FIG. 9A) are identical to the process with the plug-in sleeve 1 of the first variant. When using the plug-in sleeve 1' of the second variant, the lower second locking contour 134 is omitted, such that the groove 25 on the plug-in section 21 remains unoccupied in the third hooking-in phase (see FIG. 9B) and in the locked, final position as per the fourth hooking-in phase (see FIG. 9C). In the inclined position of the support arm 2 as per the third hooking-in phase (see FIG. 9B), the lower region of the plug-in section 21 passes into the widening 1152 which differs in terms of its spatial extent and which limits the insertion depth of the support arm 2. In the end position (see FIG. 9C), the offset is b of the plug-in section 21 comes to rest downstream of the first locking contour 1150 and therefore occupies the free space c only in sections.

The invention claimed is:

1. A hanging device, comprising a plug-in sleeve (1,1'), which is held in a through hole (502,515; 522) of a support structure (5), and a support arm (2) which can be plugged into said plug-in sleeve (1,1'), which support arm (2) can be utilized as a direct, primary merchandise carrier or for supporting a secondary merchandise carrier (3,4), wherein a) the plug-in sleeve (1,1') having:

aa) a sleeve piece (11) with a front-side inlet into a channel (115);

ab) at least one first locking contour (1150) which adjoins the channel (115), and ac) a flange (10) which extends from the sleeve piece (11);

b) the support arm (2) having:

ba) a plug-in section (21) sized to be inserted into the channel (115), ends at a plug-in end (20) and has at least one first mating contour (23) which, in an inserted end position of the support arm (2), interacts with the first locking contour (1150); and bb) a front end (22) which is situated opposite the plug-in section (21), which front end (22) is designed to extend into free space, wherein c) the first locking contour (1150) is an elevation which projects into the channel (115) from above and which is situated remote from the inlet into the channel (115);

d) the first mating contour (23) on the plug-in section (21) is a main hole (23) which is situated on an upper side with an offset (b) with respect to the plug-in end (20); and e) the channel (115) has a widening (1152) downstream of the inlet in a lower region, or a lower region of the plug-in section (21) is reduced in its extent in the downward direction in cross section, such that, before reaching its locked end position, the plug-in section (21) of the support arm (2) which is plugged into the channel (115) in a raised oblique position has free space as said plug-in section (21) deflects to its said locked end position, wherein a run-on portion (1151) is positioned upstream of the first locking contour (1150) in the direction of the inlet into the channel (115); and complementarily to the run-on portion (1151), a contour projection (24) is positioned upstream of the first mating contour (23) in the direction of the front end (22) wherein the run-on portion (1151) is designed as an inclined plane in the direction of the first locking contour (1150); and the contour projection (24) is designed as a hole extension (24) which adjoins the main hole (23) wherein the widening (1152) in the plug-in sleeve (1,1') is formed at least partially by a wall which slopes obliquely downward to an increasing extent in insertion depth of the channel (115), to allow a wall opening which contributes to the widening (1152) to adjoin the obliquely downward-sloping wall wherein a second mating contour (25) is provided in addition to the first mating contour (23) on the plug-in section (21) of the support arm (2); and a second locking contour (134) which is complementary to the second mating contour (25) is provided in the channel (115) wherein the second mating contour (25) is a groove (20) which opens out at an underside of the plug-in section (21) and at the plug-in end (20); and the second locking contour (134) is an elevation (134) which projects into the channel (115) wherein the second locking contour (134) rises up from an inner side (131) of a rear plate (13) which is to be attached to a rear face (118) of the sleeve piece (11); and a notch (117) is provided in a lower wall of the sleeve piece (11), which notch (117) opens out at the rear face (118) and provides space for partially receiving the second locking contour (134).

2. The hanging device as claimed in claim 1, wherein a) the flange (10) extends transversely through the sleeve piece (11);

b) a front section (110) of the sleeve piece (11) rises up perpendicularly from a flange front side (100);

c) a rear section (111) of the sleeve piece (11) rises up perpendicularly from a flange rear side (101);

d) the flange (10) has screw holes (104,105) for fastening to the support structure (5); and e) the front section (110) has latching contours (113) for receiving a cover ring (12) which serves to cover an edge of the through hole (502) in the support structure (5).

3. The hanging device as claimed in claim 2, wherein the flange (10) can be utilized:

a) for being placed with its front side (100) onto a panel rear side (501), with the front section (110) coming to rest in the through hole (502); or b) for being placed with its rear side (101) onto a front face (511) of a pillar (510), with the rear section (111) projecting through a cutout (515) into an interior of the pillar (510).

4. The hanging device as claimed in claim 1, wherein a) the flange (10) is integrally positioned upstream of the sleeve piece (11) and runs around the inlet into the channel (115);

b) the sleeve piece (11) has an external thread (1110) which interacts with an internal thread (144) of a cap nut (14);

c) the flange rear side (101) comes to rest, in the assembled state, on the front side (520) of the support structure (5); and the cap nut (14) is screwed onto the sleeve piece (11) from a rear side (521) of the support structure (5).

5. The hanging device as claimed in claim 1, wherein a) the support arm (2) is round, oval, rectangular or square in cross section and is composed of tube material; and b) the plug-in section (21) of the support arm (2) is unchanged in cross section in relation to the support arm (2) or is reduced in its extent in cross section in the downward direction.

6. The hanging device as claimed in claim 5, wherein, on the plug-in section (21) of the support arm (2), the reduction in a lower cross-sectional region is formed so as to be axially uniform, stepped or wedge-shaped in the direction of the plug-in end (20).

* * * * *

UNITED STATES PATENT AND TRADEMARK OFFICE

CERTIFICATE OF CORRECTION

PATENT NO. : 8,128,043 B2
APPLICATION NO. : 12/086381
DATED : March 6, 2012
INVENTOR(S) : Herbert Walter It is certified that error appears in the above-identified patent and that said Letters Patent is hereby corrected as shown below:

On the Title page, under 'Foreign Application Priority Data', "20 2005 019 809U" should be --20 2005 019 809.9--.

Signed and Sealed this
Twelfth Day of June, 2012

David J. Kappos
*Director of the United States Patent and Trademark Office*